US006900379B2

(12) United States Patent
Eugene et al.

(10) Patent No.: US 6,900,379 B2
(45) Date of Patent: May 31, 2005

(54) CONTROL DEVICE FOR MUSICAL INSTRUMENT

(75) Inventors: Christian Eugene, Louvain-la-neuve (BE); Sergiu Ivanov, Craiova (RO); Volodia Naydenov, Louvain la neuve (BE); Paul Sente, Louvain la neuve (BE)

(73) Assignees: Université Catholique de Louvain, Louvain-la-Neuve (BE); Campa S.A., Tellin (BE)

( * ) Notice: Subject to any disclaimer, the term of this patent is extended or adjusted under 35 U.S.C. 154(b) by 0 days.

(21) Appl. No.: 10/381,427

(22) PCT Filed: Sep. 25, 2001

(86) PCT No.: PCT/BE01/00168

§ 371 (c)(1),
(2), (4) Date: Jan. 9, 2004

(87) PCT Pub. No.: WO02/25629

PCT Pub. Date: Mar. 28, 2002

(65) Prior Publication Data

US 2004/0107818 A1 Jun. 10, 2004

(30) Foreign Application Priority Data

Sep. 25, 2000 (EP) ..... 00120895

(51) Int. Cl.[7] ..... G10F 1/08
(52) U.S. Cl. ..... 84/103
(58) Field of Search ..... 84/600–622, 718–720, 84/723–733, 730, 735, 103, 102, 115, 423 R, 424–437, 742, 632, 642; 446/168

(56) References Cited

U.S. PATENT DOCUMENTS 5,471,006 A * 11/1995 Schwartz et al. ..... 84/609

* cited by examiner

*Primary Examiner*—Kimberly Lockett
(74) *Attorney, Agent, or Firm*—Browdy and Neimark, P.L.L.C.

(57) ABSTRACT

Device for controlling a musical instrument, in particular a carillon, comprising a first set of keys, each key being equipped with a sensor and force regulating means, said device has a second set of striking elements, each key of the first set has assigned to it a striking element of the second set, the keys and the striking elements are mechanically dissociated from one another, said force regulating means being arranged to impose on the key with which they are associated a static force substantially identical to that which would have been imposed by the striking element if it had been connected to the key, and wherein each sensor is arranged to measure a rate of displacement of the key with which it is associated, each sensor being connected to a first signal generator arranged to receive said rate of displacement and convert it into a first signal comprising said rate and an identification of the key associated with the sensor, said first generator being connected to a transmitter arranged to transmit the first signal, each striking element being connected to a servomotor of the striking element, each servomotor being connected to a second signal generator which is connected to a receiver arranged to receive the first signal, said second generator being arranged to produce on the basis of the first signal a control signal for the striking element assigned to the sensor indicated in the first signal, each of the servomotors being arranged to impose a striking movement on the striking element with which it is associated under control of the control signal.

8 Claims, 6 Drawing Sheets

CONTROL DEVICE FOR MUSICAL INSTRUMENT

The present invention relates to a device for controlling a musical instrument, in particular a carillon, comprising a first set of keys, each key being equipped with a sensor and force regulating means.

Such a device is known from patent application EP-A-0455404. In the known device, the keys make it possible to control sound generators, in order to produce a sound. The sensor, with which each key is equipped, makes it possible to detect that the key has been activated by the musician. As for the force regulating means, these contribute towards producing an effect which has the result that the musician obtains a sensitivity in the key, comparable to that which he would normally feel if he were playing a conventional instrument.

One drawback of the known device is that its application is limited to electronic keyboards where the sound is reproduced electronically and not conventionally.

If a musician is playing a conventional instrument, like for example a carillon or a piano, it is important that he feels not only the static force in the key, but also the dynamic force. The static force consists of two components, notably one component which is due to the force of gravity and one component which is due to a restoring force, exerted on the striking element, in this case the clapper of a carillon or the hammer of the piano. The dynamic force is the force necessary for making the striking element undergo a displacement with the acceleration imposed on it by the musician who is controlling the key.

Even though the known device attempts to reproduce a sensitivity in the key, it is not able to reproduce on a striking element the control that the musician has imposed on the key. In the typical case of a carillon, the bell-ringer must directly control the clappers if he wishes to experience in the keys the sensitivity he needs for playing in a suitable manner. In practice this forces the bell-ringer to be close to the bells and therefore far from the audience.

The aim of the invention is to produce a device for controlling a musical instrument that allows a mechanical dissociation between the striking elements and the keys whilst giving the musician the sensitivity necessary for his playing.

To that end, a device according to the invention is characterized in that the device has a second set of striking elements, each key of the first set has assigned to it a striking element of the second set, the keys and the striking elements are mechanically dissociated from one another, said force regulating means being arranged to impose on the key with which they are associated a static force substantially identical to that which would have been imposed by the striking element if it had been connected to the key, and in that each sensor is arranged to measure a rate of displacement of the key with which it is associated, each sensor being connected to a first signal generator arranged to receive said rate of displacement and convert it into a first signal comprising said rate and an identification of the key associated with the sensor, said first generator being connected to a transmitter arranged to transmit the first signal, each striking element being connected to a servomotor of the striking element, each servomotor being connected to a second signal generator which is connected to a receiver arranged to receive the first signal, said second generator being arranged to produce on the basis of the first signal a control signal for the striking element assigned to the sensor indicated in the first signal, each of the servomotors being arranged to impose a striking movement on the striking element with which it is associated under control of the control signal. Despite the fact that the keys and the striking elements are mechanically dissociated from one another, the fact that the force regulating means can impose a static force substantially equal to that which would have been imposed by the striking element on the key will have the result that, when the musician activates the key, he will feel the dynamic force.

It being understood that the keys and the striking elements are mechanically dissociated from one another, the bell-ringer is no longer obliged to take up a position close to the bells, but can take his place on the square and be surrounded by listeners who will thus also become spectators.

Communication between the keys and the striking elements is carried out by means of the transmitter and the receiver. Furthermore, by measuring a rate of displacement of the key, which is converted into a first signal, it becomes possible to transmit this rate to the servomotor of the striking element in order that the movement imposed by the musician on the key is suitably transmitted to the striking element.

A first embodiment of a device according to the invention is characterized in that the excursion traveled by the key is normalized, said sensor being arranged to measure and express said rate proportionally to the value of the normalized excursion. Normalization of the excursion allows a proportional measurement of the rate of displacement, which in its turn allows a proportional control of the control rate.

A second embodiment of a device according to the invention is characterized in that said other sensor is connected to the second generator which is arranged to produce said control signal also as a function of the rate of displacement received from the other sensor. This makes it possible to impose a relative movement on the striking element.

A third embodiment of the device according to the invention is characterized in that each servomotor is equipped with an element for measuring the supply current, said measuring element being connected to a first input of a comparator, a second input of which is connected to the second generator, said comparator being arranged to compare the control signal with the measured supply current and produce on the basis of this comparison a control of the supply for the servomotor. This allows precise control of the servomotor.

The invention will now be described in a more detailed manner using the drawings that illustrate one preferential embodiment. In the drawings.

Figure 1:
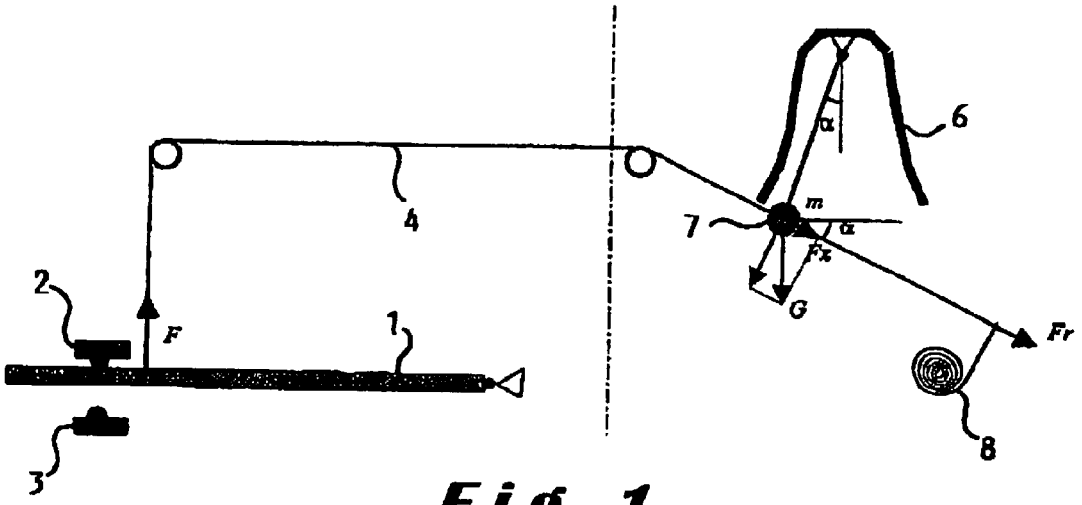
FIG. 1 illustrates a conventional carillon.

In the drawings, the same reference has been assigned to an identical element or an analogous element.

The following description relates to a carillon. But it is self-evident that the present invention is not limited to a carillon and can be applied to any musical instrument that has a key and a striking element such as for example a piano or a harpsichord.

A traditional carillon, as illustrated schematically in FIG. 1, is a musical instrument consisting of a keyboard, having a first set of keys 1, only one of which is illustrated in FIG. 1. Each key activates a striking element 7, which in the case of a carillon is formed by the clapper. All the striking elements thus form a second set. The excursion of the key is limited by two limit stops 2, 3 placed either side of the key.

In the traditional carillon, the connection 4 between the key and the clapper is mechanical, for example by means of metal wires brought back by angle irons. The keys activated by the bell-ringer have a fairly large range of movement, which allows him to strike harder or not so hard or possibly even bring the clapper slowly close to the bell 6 in order to strike small isolated or repeated blows. This mechanical connection is not carried out without loss of power which necessitates limiting its extent in space. The keyboard must therefore be situated at a short distance from the bells which implies that the bell-ringer is accommodated in the top of the tower, far from his audience.

In order to allow the return of the clapper to its rest position, a return spring 8 is connected to the clapper 7.

When the bell-ringer applies a force on the key, the force F which is applied in reaction on the key 1 is: F'=Fx+Fr+Fd where:

Fx is the component, in the direction of the movement, of the force corresponding to the weight G of the mass m of the clapper subject to the force of gravity;

Fr is the force due to the spring;

Fd is the force necessary for making the mass m undergo a displacement with an acceleration a (Fd=ma). Therefore Fd=0 in the absence of movement.

In this force there can therefore be distinguished a static component (Fr+Fx) which is independent of the imposed movement and a dynamic component Fd which depends on the acceleration.

If it is wished to allow the bell-ringer to take his place on the square in the middle of the audience, it will therefore be necessary to mechanically dissociate the keys from the striking elements, without for all that losing the sensitivity of the playing imposed by the bell-ringer. This is because it is this sensitivity that allows the listener to hear a stronger or weaker sound, a crisper or gentler striking. It is therefore important, if the keys are mechanically dissociated from the clappers, that the keyboard "resists" the bell-ringer in the same way as a conventional keyboard and that its striking is correctly analyzed in order to allow a reproduction thereof on the clappers which is as close as possible and secondarily a transcription into the standardized MIDI (Musical Instrument Digital Interface) language.

If the keyboard is mechanically dissociated from the clappers, as is the case in the present invention, it will be necessary not only to reproduce, at the keyboard, the same mechanical sensation but also to determine the position of the clapper in spatial synchronism with the position of the key. It will therefore be necessary to measure the position of each of the keys and transmit it to each of the clappers.

Figure 2:
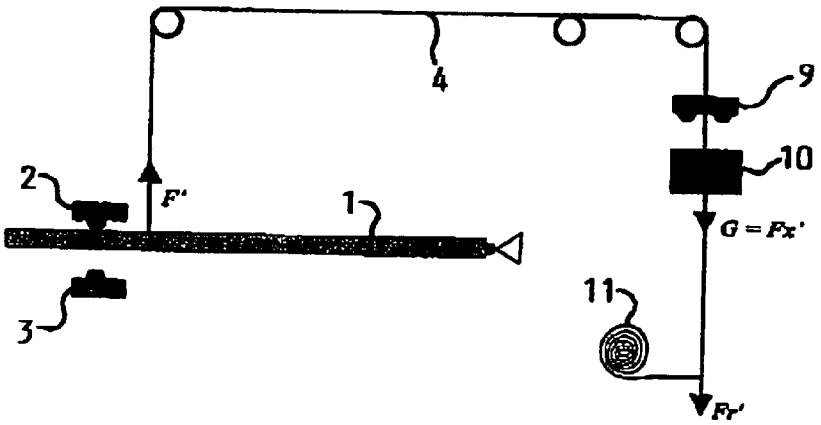
FIGS. 2 to 4 illustrate embodiments of the keys, equipped with force regulating means.
Figure 3:
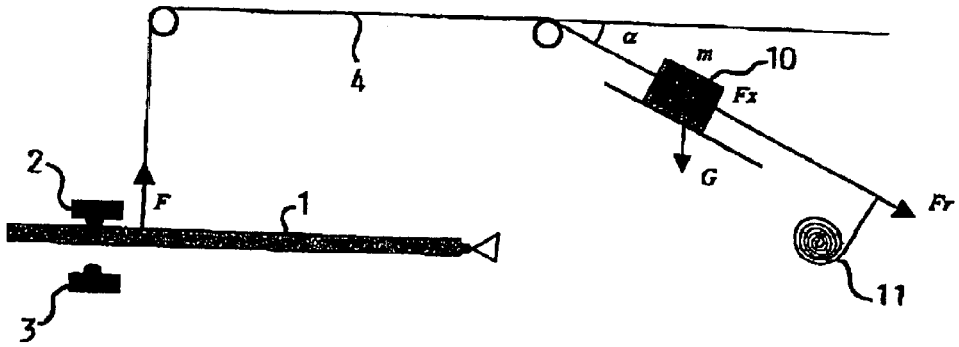
Figure 4:
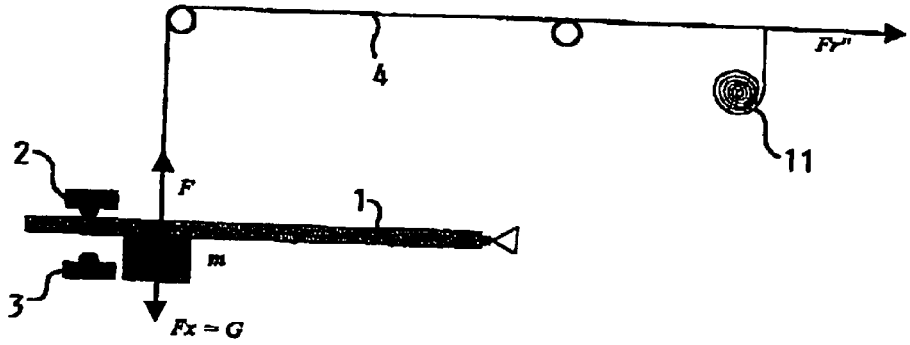

At the keyboard, it will therefore be necessary to reproduce a "force feedback" which exerts on the key a reaction force substantially identical to that which would have been imposed by the clapper if it were connected thereto in a traditional manner. In order to implement this, the invention makes provision to equip each key with force regulating means, as illustrated in FIGS. 2 to 4, which are arranged to impose on the key with which they are associated a static force substantially identical to that which would have been imposed by the striking element on the key. Thus each key 1 is connected, for example by means of a cable, a triangle or another mechanical connection 4 to a mass 10. This mass 10 is itself connected to a spring 11 that exerts a restoring force. The excursion of the mass is limited by means of a limit stop 9. As illustrated in FIG. 2, the mass can be suspended perpendicularly with respect to the ground. But it can also be inclined at an angle $\alpha$ (see FIG. 3) or parallel to the ground (FIG. 4).

In order to obtain a dynamic force equivalent to that of the traditional keyboard, it is necessary to choose a mass 10 substantially identical to that of the clapper, unless there is a different attenuating effect in the transmission of the movement. Furthermore, it is necessary for the total static force, that is to say F'=Fx'+F'r to be substantially equivalent to that obtained by a traditional carillon. Thus F'=F.

In the configuration according to FIG. 2, the whole of the force F' due to the weight is added to the restoring force Fr'. In the case of simulation of large inertias, which is the case for large bells, the masses necessary risk on their own exceeding the necessary static force. In order to resolve this problem, a negative restoring force is imposed.

When the bell-ringer now pushes on the key of the "false clapper", as illustrated in FIGS. 2 to 4, the presence of the mass 10 and the spring 11 will create a static force that is substantially identical to that of the true clapper. The dynamic force he imposes on the mass 10 by giving it an acceleration will therefore be felt as if he were playing a true carillon which will allow him to impose his playing.

Figure 5:
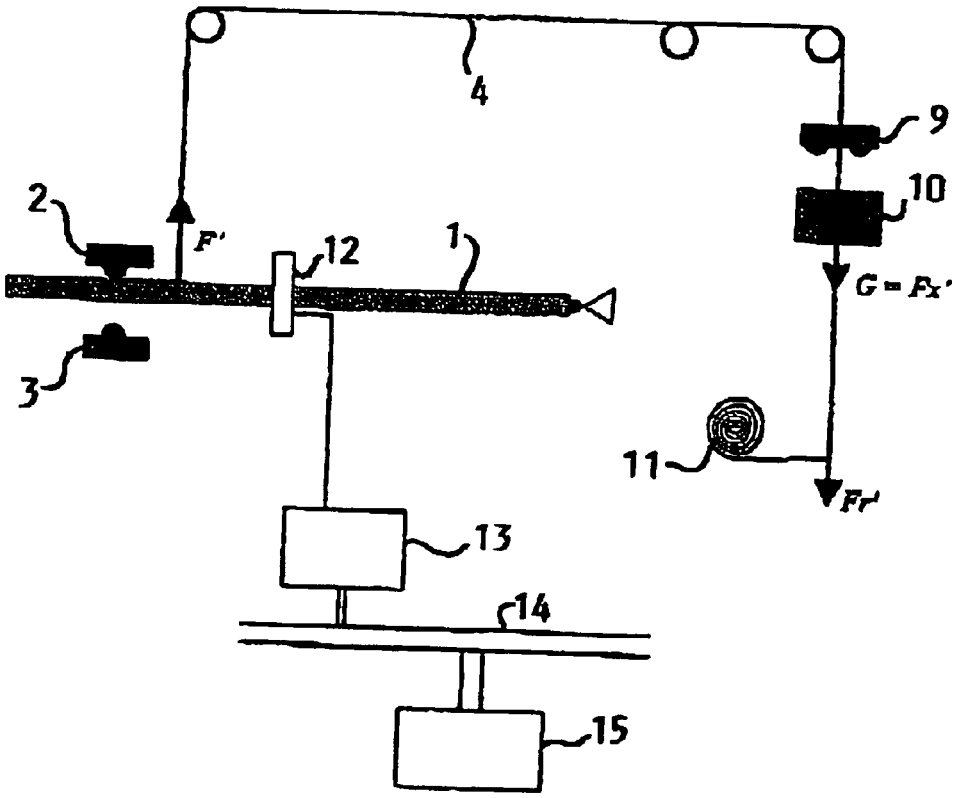
FIG. 5 illustrates a key and schematically the electronics connected thereto.

The "false clapper" therefore provides, at the keyboard, a movement of the key that is equivalent to the movement obtained with a traditional carillon key. In order to control the clapper of the bell, it is therefore necessary to measure the rate of displacement of the key. To that end, each key 1 is equipped with a sensor 12 as illustrated in FIG. 5. The sensor is for example formed by a potentiometer, a reflecting optical sensor or a Hall effect sensor. The sensor is connected to a first signal generator 13, arranged to receive the rate of displacement and convert it into a first signal that comprises this rate as well as an identification of the key that is associated therewith. The latter information can be either a number assigned to the key or an address. This identification is used to decode, at the clapper, from which key the position information comes. The first generator is connected via a bus 14 to a transmitter 15, arranged to transmit the first signal.

Preferably, the excursion traveled by the key is normalized, for example as 100 units. As the clapper must travel an excursion in synchronism with the key and the range of movement is not necessarily the same, it is advantageous to express the excursion as a normalized unit fraction. The zero point is for example the rest position while the maximum value, in this case 100, is assigned to the end of the excursion. This normalized unit fraction can not only easily be transposed onto the excursion of the clapper, but will also facilitate the production of the first signal which will have a rate proportional to the value of the normalized excursion. Thus, for example, if the clapper has traveled half its maximum excursion, the first signal will have the value 50.

The sensor will be positioned and connected to its key according to the type of sensor used. Thus for example for the potentiometer, the axis of the potentiometer will be coupled to the axis of rotation of the key. Preferably, the signals produced by the sensor will be picked up by sampling in order to quickly follow any change in position. The passband of the sensor and the first generator must be sufficient to allow reconstruction of the movement reliably. A passband of for example 100 Hz is suitable.

The first generator 13 can either be formed of a single generator and therefore be connected to all the sensors 12, or be formed of a series of first generators, each element of this series then handling a number of sensors. As for the transmitter, this can be formed of a radio transmitter, or produce a transmission by wire, telephone or optical channel. The passband of the transmitter must however be able to transmit a large amount of information coming from the keys, with a minimal delay, for example of the order of 100 ms, which corresponds to the time necessary for the sound to travel 30 meters, which is a normal distance away for the bells.

Instead of using a simple transmitter, it is also possible to use a transceiver. In the latter case, the device for controlling the clapper can transmit information, for example a failure diagnosis, to the receiver.

Figure 6:
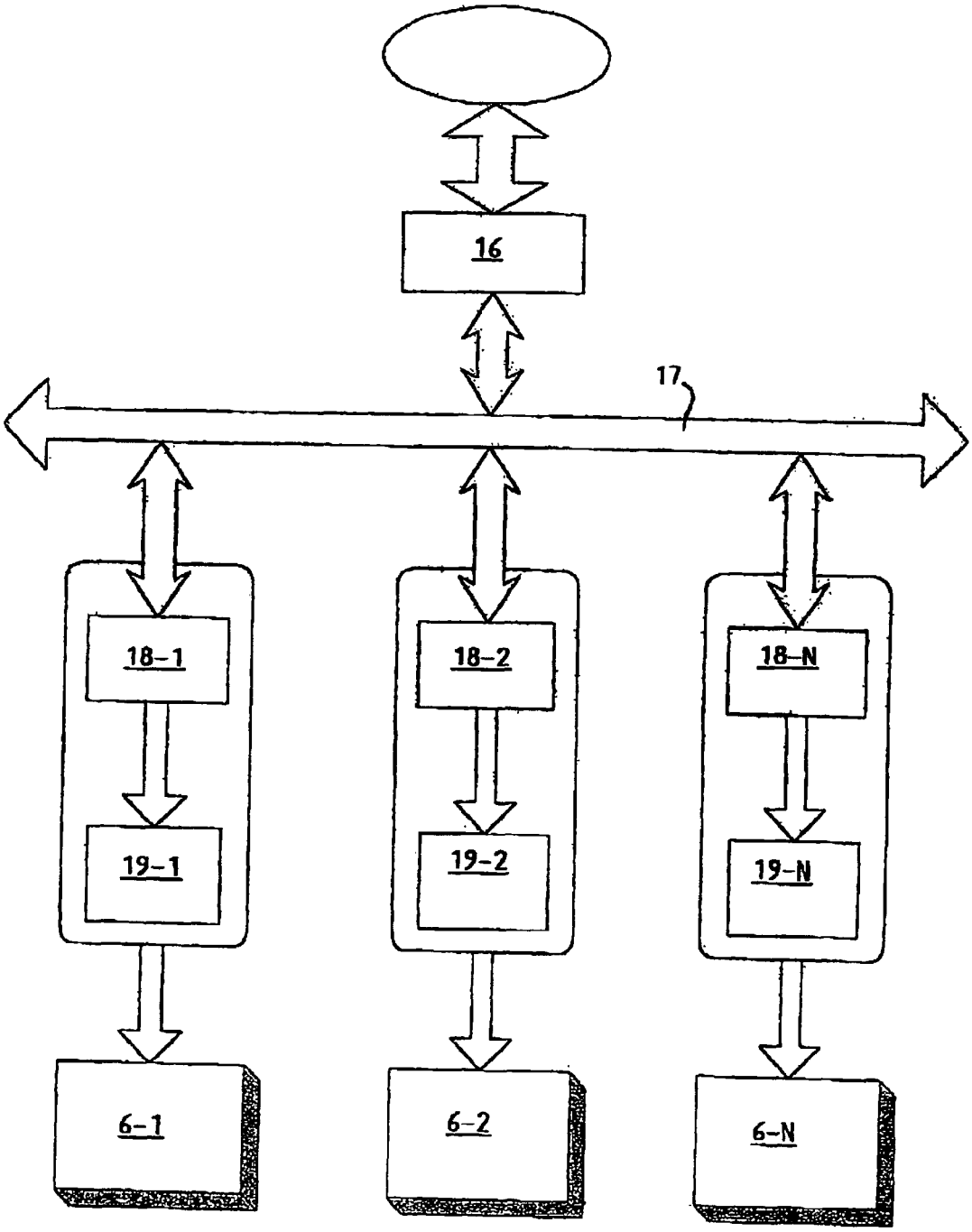
FIG. 6 illustrates schematically the electronics connected to the bell.

The first signal, produced by the first generator 13 and transmitted by the transmitter 15, will be received by the receiver 16 shown in FIG. 6. This receiver 16 is connected via a bus 17 to a second generator 18. In FIG. 6, the second generator consists of a series of modules 18-1, 18-2, . . . , 18-N so that each of the N bells 6-1, 6-2, . . . 6-N has its own module. Of course, the second generator could also consist of a single module that controls each of the bells or of a number less than the number of bells, so that each module controls some of the bells.

Each of the modules of the second generator 18 is connected to a servomotor 19-1, 19-2, . . . , 19-N. Each servomotor is arranged to impose a striking movement on the clapper of the bell 6 with which it is associated. The second generator is arranged to receive the first signal coming from the receiver and produce on the basis of this first signal a control signal that it will transmit to the servomotor with which it is associated.

In the embodiment illustrated in FIG. 6, each module of the second generator receives the different first signals received and verified, on the basis of the identification included in this first signal, if this first signal is intended for it. Let it be assumed that the key 1-2 controls the bell 6-2 and that the identification is formed by the number of the key. Thus, when the module 18-2 receives the first signal containing the identification 2, it will recognize it as being a first signal intended for the bell 6-2 and will therefore process it, whereas the other modules will ignore this first signal.

Figure 7:
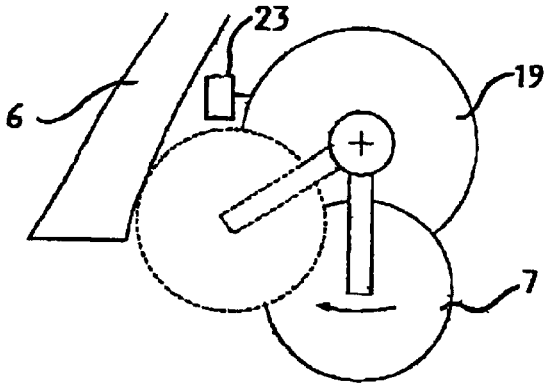
FIG. 7 illustrates a bell and its clapper.

As illustrated in FIG. 7, the servomotor 19 drives the clapper 20 in a rotational movement in order that said clapper can strike the bell 6. The motor 19 must activate the clapper in synchronism with the movement imposed by the bell-ringer on the "false clapper". This synchronism need not necessarily be in time, that is to say that the moment when the bell-ringer strikes the key need not necessarily correspond that that when the motor sets the clapper going, but the synchronism must be in movement where the clapper of the bell must follow the movement of the key.

Figure 8:
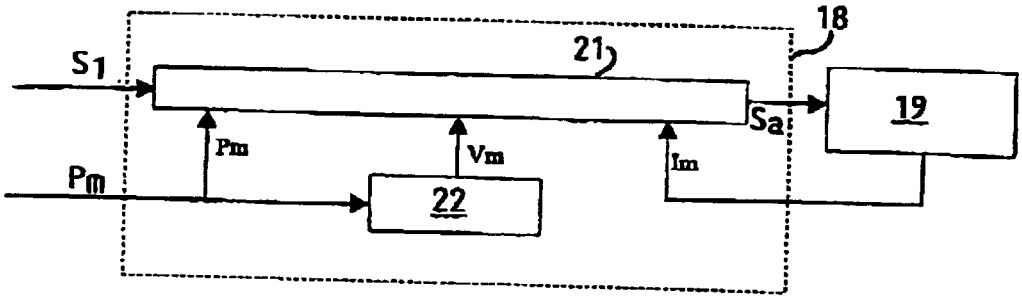
FIG. 8 illustrates the principle of controlling the clapper of the bell.

FIG. 8 illustrates schematically the function of the second generator 18. The first signal S1 is supplied to a first input of this second generator. The position of the clapper Pm is preferably supplied to a second input of the second generator. Not measuring the position of the clapper and bringing it back each time to its rest point can also be envisaged. However, this implementation does not make it possible to obtain the same accuracy as that where Pm is determined.

The second generator 18 has a clapper position and speed regulator 21 and a clapper speed calculator 22. These components can either consist of discrete components or be integrated into a microprocessor. The calculator 22 calculates the speed of the clapper on the basis of the position signal Pm. This is because the variation in the position of the clapper over time indicates its speed Vm. The speed Vm, the position Pm and the first signal S1 are supplied to the regulator 21, which also receives a measurement of current Im supplied to the servomotor 19. On the basis of these data, the regulator will determine a control signal Sa that will be supplied to the motor 19.

In order to facilitate determination of the position signal Pm, the excursion of the striking element is preferably normalized, just as is the case of the excursion of the key. To that end, another sensor 23 (see FIG. 7) is associated with the servomotor 19 and the clapper 7. The other sensor is arranged to measure the rate of displacement of the clapper and express the position signal Pm proportionally to the value of the normalized displacement. For expressing the rate of displacement of the clapper, the zero value is for example assigned to the rest position of the clapper (that is to say moved away from the bell) and the maximum value to the position where the clapper is in contact with the bell. The other sensor is for example formed by a potentiometer, an optical sensor or a Hall effect sensor. Preferably, the sensor associated with the key and that associated with the clapper have the same configuration, which limits the risk of error and facilitates the calculation. The passband of the other sensors is preferably less than 100 Hz.

Figure 9:
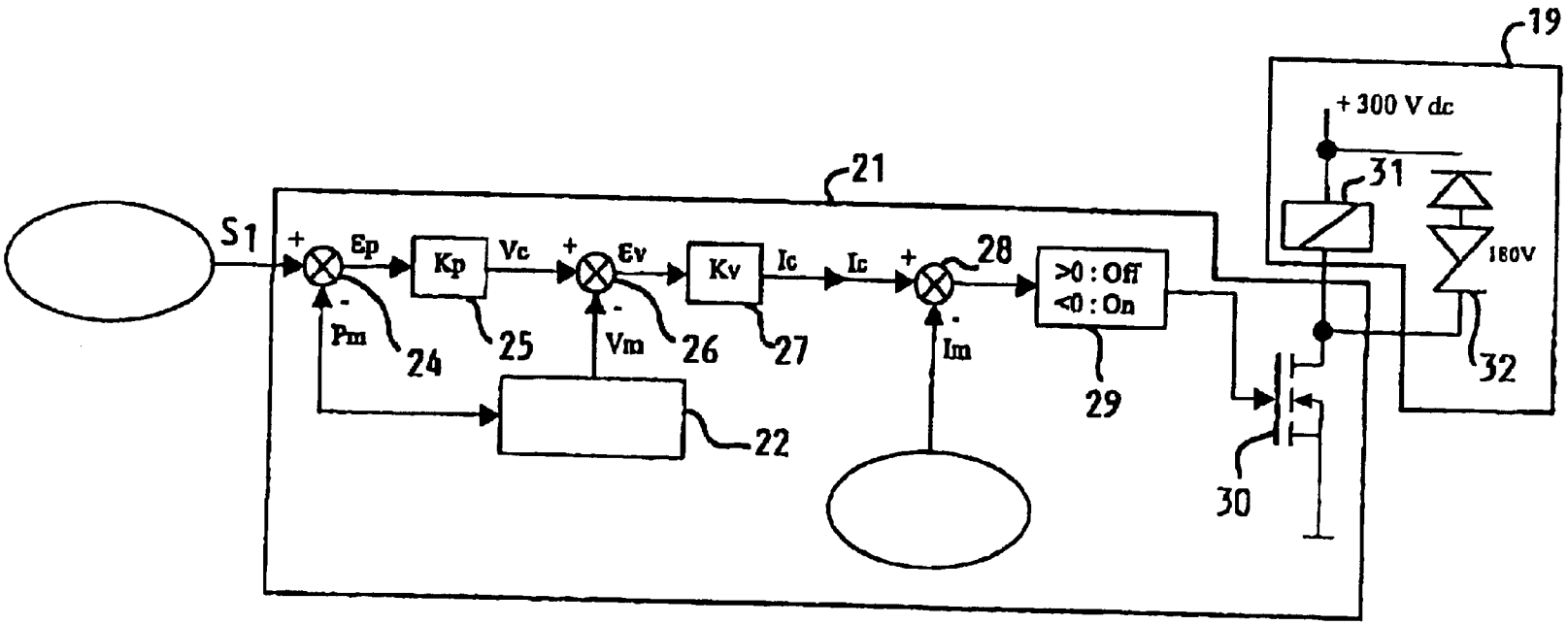
FIG. 9 illustrates the way in which the control signal is determined.

The formation of the control signal Sa, as formed by the second generator, is illustrated schematically in FIG. 9. The first signal S1 and the position signal Pm are supplied to a first comparator 24 that determines the difference Ep between the rate indicated by S1 and the rate indicated by Pm, that is to say the difference between the received position of the key (S1) and the measured position of the clapper (Pm).

The difference value $\epsilon p$ is converted into a speed signal Vc by a first converter 25. The speed signal Vc is proportional to $\epsilon p$. The signal Vm, produced by the speed calculator 22 and which indicates the current speed of the striking element, is supplied to a second comparator 26 that also receives the speed signal Vc. The second comparator 26 determines the difference $\epsilon v = Vc - Vm$.

The second comparator 26 is connected to a second converter 27 that converts the difference value $\epsilon v$ into a current signal Ic proportional to $\epsilon v$. The second converter 27 is connected to a third comparator 28 that also receives the value Im of the supply current, supplying the servomotor 19. The second comparator determines the difference between Ic and Im in order to check whether the supply current Im agrees with the setting current Ic.

The signal $\epsilon i = Ic - Im$ is supplied to a switch 29 which supplies a current to the gate of a transistor (MOSFET or IGBT) 30 when $\epsilon i < 0$ and supplies no electrical current to the transistor if $\epsilon i > 0$. The transistor 30 is connected between earth and a solenoid coil 31 of the servomotor 19.

Thus when $\epsilon i < 0$, that is to say when the current Im which flows in the servomotor is less than the signal Ic, the transistor is made conductive and more current can flow in the motor for activating the clapper. Since a value $\epsilon i < 0$ means that $Ic > Im$, this means that the key has been pressed by the bell-ringer and therefore that the clapper must be accelerated. Thus a current will be supplied to the clapper that is proportional to the movement of the key. When the bell-ringer releases the key, $\epsilon i > 0$ and therefore the supply will be cut off so as to no longer accelerate the clapper. The clapper thus follows the movement of the key in a synchronized manner.

The zener diode 32 connected in parallel with the coil 31 provides a demagnetization of the current in the servomotor.

What is claimed is:

1. A musical instrument comprising a plurality of keys and a plurality of striking elements, each of said striking elements being associated with, and being controlled by operation of, a respective one of said keys, wherein said keys and said striking elements are mechanically dissociated from one another, and said instrument further comprises:

a plurality of sensors each operatively associated with a respective one of said keys for producing a sensor signal representative of the rate of displacement of said respective key when said key is actuated;

a plurality of force regulating means each coupled to a respective one of said keys for applying to said respective key a static force value corresponding to the static force that would be applied to said respective key by said associated striking element if said respective key were mechanically coupled to said associated striking element;

first signal generating means coupled to said sensors to receive the sensor signals and convert the sensor signals into first signals representing the displacement rate of each of said keys that is being displaced and containing identification of each of said keys that is being displaced;

a transmitter coupled to said first signal generating means for transmitting the first signals;

a receiver disposed for receiving the first signals transmitted by said transmitter;

second signal generating means coupled to said receiver, said second signal generating means being arranged to generate, in response to the first signals, control signals for each of said striking elements associated with a key for which a sensor signal has been produced; and a plurality of servomotors each coupled to said second signal generating means and a respective one of said striking elements for activating the respective one of said striking elements, each of the servomotors being arranged to activate, in response to a respective one of the control signals, the respective one of said striking elements in order to cause the respective one of said striking elements to execute a striking movement.

2. The musical instrument of claim 1, wherein each of said sensors is calibrated according to a normalized excursion range of said associated key so that the sensor signal represents a normalized value of the rate of key displacement.

3. The musical instrument of claim 1, further comprising a plurality of second sensors each associated with a respective one of said striking elements, each of said second sensors being calibrated according to a normalized excursion value of said respective one of said keys associated with said respective one of said striking elements, each of said second sensors being operative to produce a second sensor signal representing the rate of displacement of said respective striking element as a normalized excursion value.

4. The musical instrument of claim 3, wherein each of said second sensors is connected to said second signal generating means for causing the control signals produced by said second signal generating means to also be functions of the second sensor signals.

5. The musical instrument of claim 4, wherein each of said second sensors is also operative to provide an indication of the speed of said associated striking element, and said second signal generating means are operative to cause the second control signals to be functions of the speed indications produced by said second sensors.

6. The musical instrument of claim 1, wherein each servomotor comprises a measuring element for measuring a current supplied thereto, and said instrument further comprises a plurality of comparators each associated with a respective servomotor, each said comparator having a first input connected to receive a signal from said measuring element of said respective servomotor, a second input connected to said second signal generating means, and an output, said comparator being arranged to compare a respective control signal from said second signal generating means with the current measured by said measuring element and to produce, on the basis of the comparison, a control of the current supplied to said respective servomotor.

7. The musical instrument of claim 1, wherein each of said force regulating means comprises a mass connected mechanically to the respective key and to a spring.

8. The musical instrument of claim 1, wherein:

each of said striking elements is equipped with a further sensor calibrated according to a normalized excursion value of said key and operative for measuring the rate of displacement of said striking element and expressing the measured rate according to the normalized excursion value;

each said servomotor is equipped with a current measuring element for measuring a current supplied thereto; and said instrument further comprises a plurality of comparators each associated with a respective servomotor, each said comparator having a first input connected to receive a signal from said measuring element of said respective servomotor, a second input connected to said second signal generating means, said comparator being arranged to compare a respective control signal from said second signal generating means with the current measured by said measuring element and to produce, on the basis of the comparison, a control of the current supplied to said respective servomotor.

* * * * *